United States Patent [19]

King

[11] 4,192,281

[45] Mar. 11, 1980

[54] CROSSBOW WITH TRIGGER LOCKING DEVICE

[76] Inventor: Fred V. King, 1605 S. Independence, Harrisonville, Mo. 64701

[21] Appl. No.: 902,297

[22] Filed: May 3, 1978

Related U.S. Application Data

[63] Continuation of Ser. No. 805,301, Jun. 10, 1977, abandoned.

[51] Int. Cl.[2] ..... F41B 5/00

[52] U.S. Cl. ..... 124/25; 124/40; 124/35 A

[58] Field of Search ..... 124/25, 35 R, 35 A, 124/22, 40, 26, 27, 31, 16, 17, 21

[56] References Cited

U.S. PATENT DOCUMENTS

| | | | |
|---|---|---|---|
| 1,486,403 | 3/1924 | Watkins | 124/35 R X |
| 3,224,427 | 12/1965 | Ronan | 124/25 |
| 3,490,429 | 1/1970 | Benedict | 124/25 X |
| 4,030,473 | 6/1977 | Puryear | 124/35 R |

*Primary Examiner*—William R. Browne
*Attorney, Agent, or Firm*—Fishburn, Gold & Litman

[57] ABSTRACT

A crossbow having a trigger device for retaining and releasing a crossbow string comprises a crossbow string holding arm, a trigger arm, and a locking lever, each being pivotally mounted between the sideplates of a trigger assembly housing. The trigger arm engages a portion of the holding arm in a cocked position for securingly holding the crossbow string, and is pivotable out of engagement with the holding arm, thereby releasing the bowstring for firing an attached arrow. The locking lever prevents trigger arm rotation in a locked position, and is rotatable therefrom to an unlocked position for arrow release. The holding arm is mounted in a trigger assembly housing adjacent to the locking lever, and selectively abuts the same, whereby rotation of the holding arm during a portion of the cocking operation, automatically and contemporaneously pivots the safety lever toward the locked position.

9 Claims, 5 Drawing Figures

CROSSBOW WITH TRIGGER LOCKING DEVICE

This is a continuation of application Ser. No. 805,301, filed June 10, 1977, now abandoned.

BACKGROUND OF THE INVENTION

This invention relates to trigger mechanisms, and in particular to a trigger device for crossbows having an automatic safety.

Trigger devices for crossbows, such as the mechanism disclosed in U.S. Pat. No. 3,490,429, issued to D. S. Benedict on Jan. 20, 1970, have included safety members for selectively holding or locking the trigger against inadvertent movement. Such devices do not include means for automatically activating the safety when the crossbow is cocked, and are generally not designed for use in conjunction with high tension crossbows.

The primary objects of the present invention are: to provide a crossbow with a trigger device for crossbows having an automatic safety mechanism; to provide such a device having a bowstring retaining arm, a trigger arm, and a safety lever, wherein rotation of the retaining arm into a cocked position contemporaneously pivots the safety lever into a locked position; to provide such a device for use with high tension crossbows; to provide such a device wherein the crossbow string engages the retaining arm and pivots the same into the cocked position; to provide such a device which includes a bowstring guard disposed over the top portion of the device for guiding the bowstring into engagement with the retaining arm and cocking the same; to provide such a device having a resilient bumper mounted in the housing and disposed in the rotational path of the bowstring retaining arm for limiting the rotation of retaining arm subsequent to bowstring release; to provide such a device having a leaf spring urging the retaining arm into a normally, generally, vertical orientation for efficient crossbow cocking; to provide such a device wherein a trigger arm edge which engages the release arm is arcuately shaped along a center concentric with the axis of a retaining pin connecting the same in the housing for smoooth bowstring release; and to provide such a device which is economical to manufacture, and particularly well adapted for the proposed use.

Other objects and advantages of this invention will become apparent from the following description taken in connection with the accompanying drawings wherein are set forth, by way of illustration and example, certain embodiments of this invention.

The drawings constitute a part of the specification and include exemplary embodiments of the present invention and illustrate various objects and features thereof.

Figure 1:
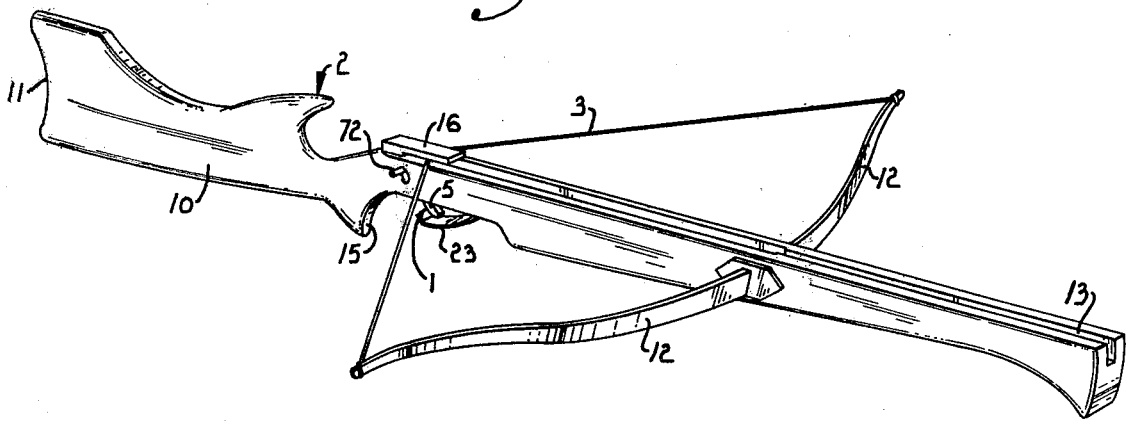
FIG. 1 is a perspective view of a crossbow trigger device embodying the present invention, said trigger device being mounted in a crossbow.

Referring more in detail to the drawings:

The reference numeral 1 generally designates a trigger device for use in conjunction with a crossbow 2. The trigger device holds and releases the bowstring 3 of the crossbow, and comprises a retaining arm 4, a trigger arm 5, and a safety lever 6, each being pivotally mounted between the sideplates of a trigger assembly housing 7.

The crossbow 2 may be of any suitable design, and in this example comprises a stock 10 having a shoulder rest 11 formed at one end thereof, and resilient bow springs 12 attached to the other end of the stock. A longitudinally disposed channel 13 is formed in the upper surface of the stock 10 to guide the arrow. A transversely disposed aperture 14 is provided in the medial portion of the stock adjacent to a grip area 15, and is shaped to receive and clamp the trigger device 1 therein. The illustrate crossbow 2 includes a hood or guard member 16 mounted on the top surface of the stock over the trigger mechanism, and prevents the bowstring 3 from accidentally being displaced from the retaining arm 4 when the bow is in a cocked position. The illustrated crossbow is a relatively heavy bow, having a bowstring pull in the nature of 140–200 pounds.

The trigger device housing 7 includes a pair of parallel sideplates 17 and 18, between which the retaining arm 4, trigger arm 5, and safety lever 6 are each pivotally mounted. The housing 7 is shaped to fit snugly into the stock aperture 14, and is adapted to be securely clamped therein. The illustrated housing comprises a base and an end member 19 and 20 respectively, positioned between the sideplates 17 and 18 and attached therethrough by suitable fastening means, such a screws 21. The forward end 22 of the base member 19 projects outwardly from the sideplates and includes a trigger guard 23 attached thereto by fastening screw 24. A front edge 25 of the trigger guard 23 forms a clip which engages the crossbow stock 10 adjacent the lower, forward edge of the aperture 14. A second clip 26, having a L-shape, is attached to the end member 20 on the interior surface thereof, and includes a projecting edge 27 which abutts the stock 10 at the lower, rearward portion of the aperture 14. A fastening plate 28 has one end 29 thereof disposed in a slot 30 positioned at the upper, rearward portion of the stock, and the forward end thereof is connected by a suitable fastener, such as the illustrated bolt 31 to the upper end of the housing end member 20. The forward edge 25 of the trigger guard, in combination with clip 26 and fastening plate 28, securely, yet removably clamp the trigger device 1 in the crossbow stock 10. In this example, the upper edge 32 of each housing sideplate 17 and 18 includes a series of notches 33 which provide clearance for the rotating retaining arm 4 and safety lever 6.

Figure 2:
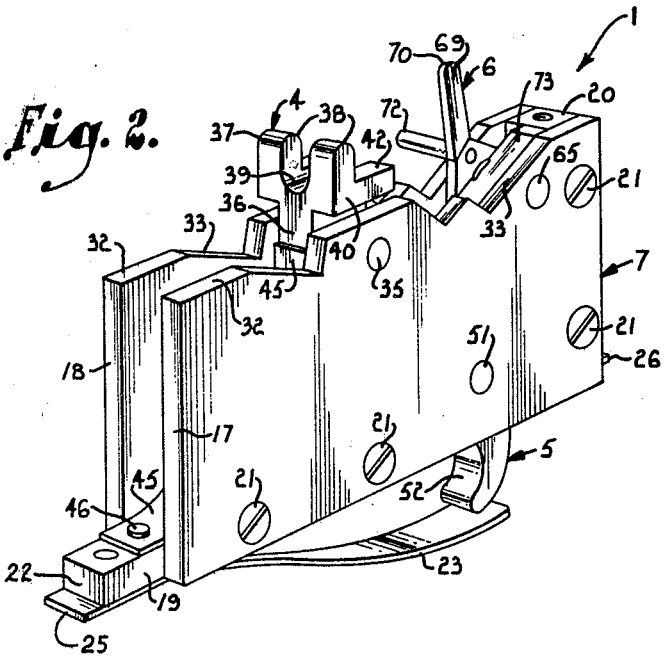
FIG. 2 is an enlarged perspective view of the crossbow trigger device.
Figure 4:
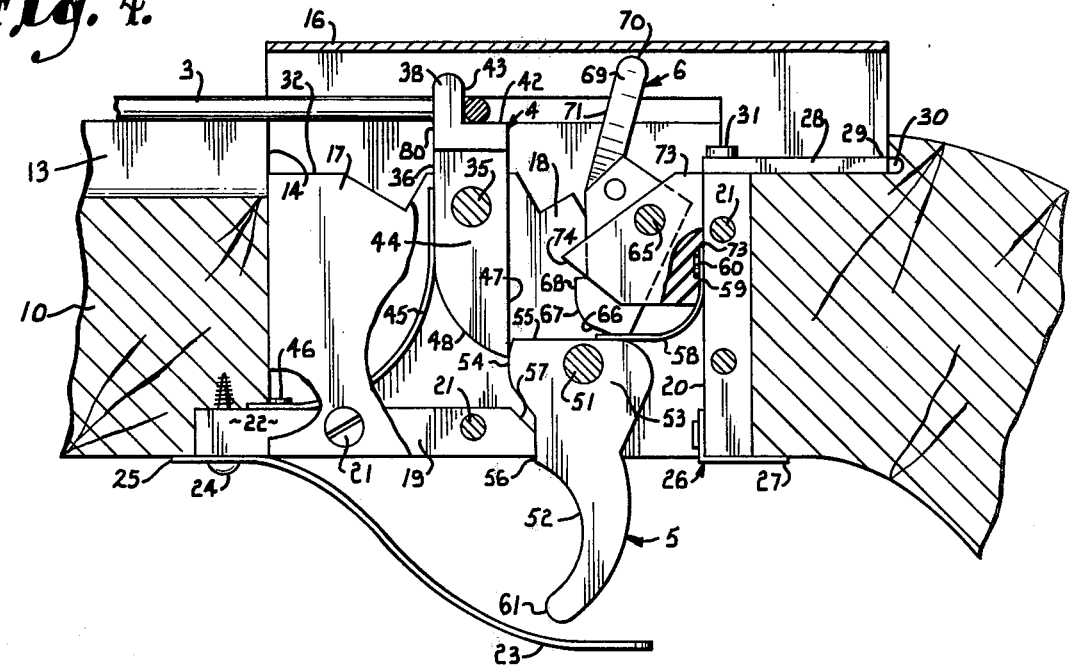
FIG. 4 is a fragmentary side elevational view of the crossbow and trigger device therefor in a locked position, and having portions thereof broken away.
Figure 5:
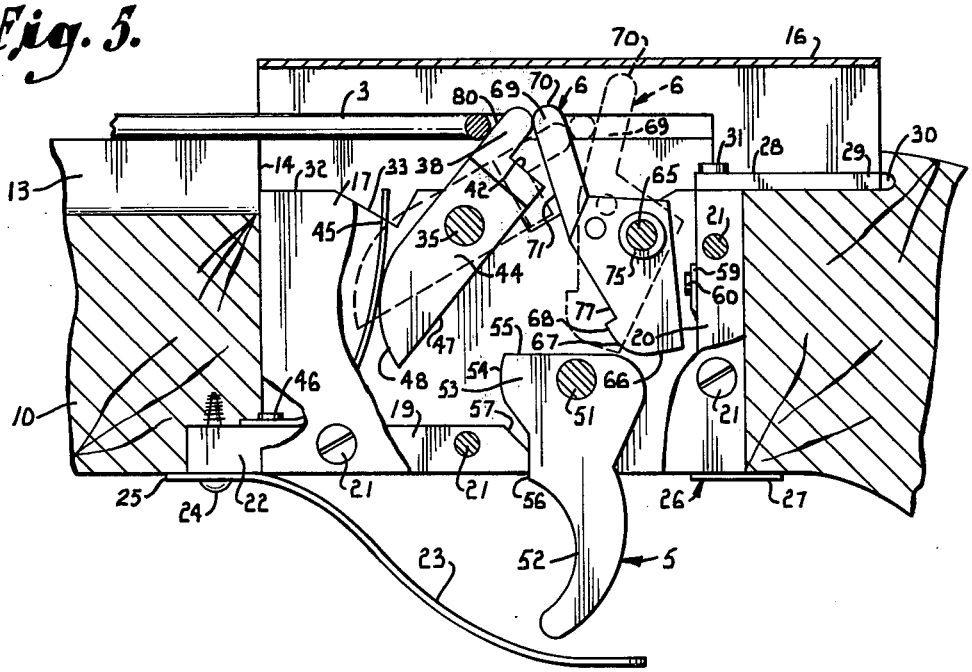
FIG. 5 is a side elevational view of the crossbow trigger device in an unlocked position, and with portions thereof broken away.

The bowstring retaining arm 4 is pivotally mounted between the housing sideplates 17 and 18 by a pin 35. The illustrated retaining arm 4 has a flat base 36 slidably positioned between the housing sideplates, and a U-shaped top member 37 extending above the upper edges 32 of each sideplate. The top member 37 includes a pair of ears 38 which extend upwardly in spaced relation to form a groove 39 therebetween for receiving an arrow shaft (not shown) therein. In the illustrated structure, the side surfaces 40 of the top member 37 are substantially planar with the outer surfaces of the housing sideplate 17 and 18, and during operation, the top member mates with the sideplate grooves 33. The retaining arm top member 27 includes a base surface 42 and a rearward surface 43 of the ears 38, which in conjunction provide means for holding the bowstring 3 in a cocked position, as shown in FIG. 4. In this example, the upper surface of each ear 38 is rounded for accurate bowstring release. The retaining arm 4 is pivotally mounted in the housing 7 at a medial portion 44 thereof, and resilient means, such as the illustrated leaf spring 45 urges the arm into an upright position, which, in the attitude shown in FIGS. 6 and 2 and 5 is normally, generally vertical. In the upright position, the free end of the leaf spring 45 abuts the arm 4 subtantially in line with the center of the retaining pin 35, and a fastener, such as pop rivet 46 attaches the other end of the spring to the housing base member 19. The lower, rearward surface 47 of the arm 4 abuts the trigger arm 5, and preferably has a flat shape. The forward edge 48 of the arm 4 has an arcuate shape for cooperating interaction with the trigger arm 5 as subsequently described.

The trigger arm 5 is pivotally mounted between the housing sideplates 17 and 18 by a pin 51. The trigger arm 5 comprises an arcuately shaped lower portion 52 adapted for engagement with the user's finger, and an enlarged upper portion 53, through which the mounting pin 51 is transversely disposed. A forward, upper edge 54 of the trigger arm 5 is rounded and mates with the flat edge 47 of the bowstring retaining arm 4. In this example, the trigger arm edge 54 has an arcuate shape concentric with the axis of the retaining pin 51 for smooth bowstring release. The arcuately shaped trigger edge 54 is abruptly interrupted by flat portion 55 for quick disengagement with the retaining arm 4. A medial edge portion 56 of the trigger arm is urged abuttingly against the rearward end 57 of the housing base member 19 by resilient means, and forms a stop to hold the trigger in a forwardmost position. In this example, a leaf spring 58 engages a portion of the trigger arm 5 rearward of the pin 51, and has the other end 59 thereof attached to the housing end member 20 by a suitable fastener, such as the illustrated pop rivet 60. The trigger guard 23 extends rearwardly beyond and adjacent to the free end 61 of the trigger, and prevents inadvertent movement thereof. The bowstring retaining arm 4 and trigger arm 5 are each preferably constructed of a hardened steel for durable operation in heavy bows having bowstring pull in the nature of 140–200 pounds.

Figure 3:
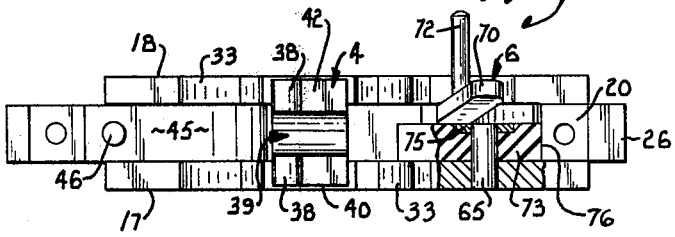
FIG. 3 is a top plan view of the crossbow trigger device, with a portion thereof broken away to show internal construction.

The safety lever 6 is pivotally mounted between the housing sideplates 17 and 18 by a retaining pin 65. The safety lever 6 comprises a substantially flat bottom edge 66 which is arcuately contoured at a rounded portion 67 thereof into a rectilinear side 68. The bottom edge 66 is shaped for selective, abutting engagement with the trigger edge 55, for alternately preventing and permitting rearward pivoting of the trigger arm. In the structure illustrated in the FIG. 4, when the safety lever 6 is pivoted in a fully clockwise direction, the trigger device is in a locked position, whereby rotation of the trigger arm 5 is limited to the extent that engagement between the retaining arm 4 and the trigger arm 5 is maintained. When the safety lever 6 is placed in a forward position, such as that illustrated by the full lines in FIG. 5, the trigger edge 55 clears the rounded portion 67 of the safety lever 6, and trigger edge 54 disengages the mating retaining arm surface 47 to release the bowstring. The safety lever 6 includes an upstanding projection 69 having an arcuately shaped upper end 70, and a forward edge 71 adapted for abutting the bowstring retaining arm ears 38. In the illustrated structure, the safety lever is flat and the projection 69 is angled slightly toward housing side plate 18 (FIG. 3) for positive engagement with the retaining arm 4. An extension arm 72 is threadedly connected to the safety lever and laterally projects therefrom, and facilitates manipulation of the safety lever. The extension arm may project from either side of the safety lever to facilitate both right and left handed users, and in this example projects from an arcuately shaped slot in the stock 10. A resilient bumper 73 is mounted in the housing and is disposed in the rotational path of the pivoting retaining arm 4 for engagement therewith. The illustrated bumper 73 includes a flat forward surface 74 angled to mate with an associated portion of the arm edge 46 to dampen the impact therebetween. The side edge 68 of the safety lever includes a notch 77 to prevent interference between the trigger arm 4 and the bumper 68. In the illustrated structure, the bumper 73 has substantially flat, parallel sides, is constructed of rubber, and as best illustrated in FIG. 3, is disposed between the housing side plate 17 and safety lever 6, is separated therefrom by a washer 75, and is attached to the housing by the retaining pin 65. A flat rearward edge 76 of the bumper abuts the housing end member 20 and prevents rotation of the bumper. The bumper is flexible and resilient, and the transverse dimension thereof is selective such that the total thickness of the safety lever 6, washer 75 and bumper 73 is substantially greater than the space between the housing side plate 17 and 18, whereby the washer 75 is impressed in the bumper side and the safety lever is frictionally retained in the position in which it is pre-set.

In operation, to fire the crossbow, the user first positions the safety lever 6 in the "off" position by rotating the same toward the front of the device. The rotational path, of the trigger arm 5 is then unobstructed, and the user pulls or rotates the trigger rearwardly. Continued rotation causes the abutting surfaces 54 and 47 of the trigger and retaining arms to disengage, whereby the bowstring and arrow are propelled forwardly. The leaf spring 45 immediately returns the retaining arm 4 to an upright position such that when the user releases the trigger to assume its forwardly position, mating surfaces 47 and 54 automatically abut. If the curved surface 48 of the retaining arm is inadvertently positioned on the top surface 55 of the trigger arm, which might be caused by early trigger return, the retaining arm surface 48 is shaped in a manner whereby forward pressure on the retaining arm ears 38 will resert the device to its proper position. The leaf spring 58 automatically returns the trigger arm 5 to its proper position. To cock the crossbow, the user draws the bowstring 3 rearwardly, either manually or with mechanical means such as a cocking mechanism, until the string engages the forward surface 80 of the trigger arm top portion 37, as shown in FIG. 5. It is noted that the safety lever 6 is, immediately after firing, in the forwardlymost, "off" position. In the attitude shown in FIG. 5, continued rearward movement of the bowstring 3 causes the retaining arm 4 to pivot in a clockwise direction. The ears 38 of the retaining arm abuttingly engage the upwardly projection portion 69 of the safety lever and similarly pivot the same rearwardly by positive displacement in a clockwise direction. When the bowstring has been drawn back to a position wherein the same clears the uppermost surface of the retaining arm ears, as illustrated by the phantom lines in FIG. 5, the safety lever 6 has been rotated into a locked position wherein rotation of the trigger arm 5 is prevented. At the point where the bowstring 3 is about to clear the retaining arm ears 38, the bowstring abuts the safety lever 6 and rotates the same slightly rearwardly into a fully rearward, locked position. The leaf spring returns the retaining arm 4 to an upright position and urges the abutting surface 47 thereof against mating trigger edge 54. The bowstring is then moves forwardly into engagement with the rearward surface 43 of the retaining arm ears 38 and is held herein for loading an arrow and subsequent crossbow firing. Abutting engagement between the upper surface of the stock and the bowstring 3 prevents interference between the bowstring and the upper rearwardly edge of the retaining arm 4. It is to be noted that if the user manually rotates the safety lever into the "on" position after firing, the cocking of the bowstring may still be accomplished in the above described manner. If the safety lever is not manually manipulated, the cooperating interaction between the retaining arm 4, trigger arm 5, and safety lever 6 automatically and positively places the crossbow in a locked position whenever the same is cocked, thereby providing greater safety for the user. The hood or guard member 16 prevents that cocked bowstring from inadvertently disengaging from the set release arm, and also insures that the bowstring engages the front surface 80 of the retaining arm 4 to set the automatic safety.

It is to be understood that while certain forms of this invention have been illustrated and described, it is not to be limited to the specific form or arrangement of parts herein described and shown, except insofar as such limitations are included in the following claims.

What is claimed and desired to be secured by Letters Patent is:

1. A trigger device for holding and releasing a crossbow string, comprising:

(a) housing means housing said trigger device and adapted for connection with a crossbow;

(b) holding means for a crossbow string, being rotatably mounted in said housing means and pivotable between first and second positions for holding and releasing said string respectively;

(c) trigger means mounted in said housing means and engaging a portion of said holding means and retaining said holding means in said first position when said trigger means is in a first trigger position; said trigger means being pivotable to a second trigger position wherein said trigger means is out of engagement with said portion and permits said holding means to pivot to its second position thereby releasing a crossbow string; and (d) locking means mounted in a crossbow housing means and pivotable between a lock position and an unlock position; in said lock position, said locking means engaging said trigger means and preventing rotation thereof from said first trigger position, thereby preventing a crossbow string release; in said unlock position, said locking means permitting rotation of said trigger means from the first to the second trigger position, thereby permitting a crossbow string release; said locking means releasably engaging said holding means during a portion of a crossbow string cocking operation, whereby rotation of said holding means by action of a crossbow bowstring, from the second to the first position of the holding means, automatically causes the holding means to engage and contemporaneously pivot said locking means from the unlocked position toward the locked position.

2. A device as set forth in claim 1 wherein:

(a) said housing means comprises a pair of parallel side plates having said holding means, said trigger means and said locking means pivotally connected therebetween.

3. A device as set forth in claim 2 wherein:

(a) said holding means, said trigger means, and said locking means comprises a retaining arm, a trigger arm, and a safety lever respectively.

4. A device as set forth in claim 3 including:

(a) a resilient bumper mounted in said housing means and positioned in the rotation path of a portion of said retaining arm for abutting and limiting pivotal motion of the same.

5. A device as set forth in claim 4 wherein:

(a) said bumper exerts lateral force on said safety lever and resiliently urges the same toward one of said housing means side plates for frictionally retaining the safety lever in a preset position.

6. A device as set forth in claim 4 wherein:

(a) said bumper includes a rectilinear surface inclined to flushly engage said retaining arm portion for dampening impact therebetween.

7. A device as set forth in claim 3 including:

(a) first resilient means urging said retaining arm into said holding means first position; and (b) second resilient means urging said trigger arm into said first trigger position.

8. A device as set forth in claim 3 wherein:

(a) said trigger arm is pivotally mounted between said housing means side plates by a cylindrically shaped pin having a central axis disposed perpendicularly to said side plates, and said trigger arm includes an edge portion engaging said retaining arm and holding the same in said first position; and (b) said trigger arm edge portion has an arcuate shape concentric with the axis of said cylindrically shaped pin for smooth crossbow string release.

9. In a crossbow having a bowstring, the improvement comprising:

(a) a trigger device for holding and releasing the crossbow bowstring; said trigger device including:

(1) housing means connected with the crossbow;

(2) holding means for said crossbow string, being rotatably mounted in said housing means and pivotable between first and second positions for holding and releasing said crossbow string respectively;

(3) trigger means mounted in said housing means and engaging a portion of said holding means and retaining said holding means in said first position when said trigger means is in a first trigger position; said trigger means being pivotable to a second trigger position wherein said trigger means is out of engagement with said portion and permits said holding means to pivot to its second position and release said crossbow string;

(4) locking means mounted in said housing means and pivotable between a lock position and an unlock position; in said lock position, said locking means engaging said trigger means and preventing rotation thereof from said first trigger position, thereby preventing a crossbow string release; in said unlock position, said locking means permitting rotation of said trigger means from the first to the second trigger position, thereby permitting said crossbow string release; said locking means releasably engaging said holding means during a portion of said crossbow string cocking operation, whereby rotation of said holding means by action of the crossbow string, from the second to the first position of the holding means automatically causes the holding means to engage and contemporaneously pivot said locking means from the unlocked position toward the locked position; and (b) a crossbow string guard connected with the crossbow, and having a top portion thereof disposed adjacent to an upper member of said holding means and guiding said crossbow string into engagement with said holding means during cocking.

* * * * *